United States Patent [19]

Cooley

[11] Patent Number: 4,755,640

[45] Date of Patent: Jul. 5, 1988

[54] MECHANICAL ACTUATED FLOAT SWITCH

[75] Inventor: Claude F. Cooley, Owosso, Mich.

[73] Assignee: CSH, Inc., Owosso, Mich.

[21] Appl. No.: 42,846

[22] Filed: Apr. 27, 1987

[51] Int. Cl.[4] ..... H01H 35/18

[52] U.S. Cl. ..... 200/84 R; 73/313; 200/61.83; 340/625

[58] Field of Search ..... 340/613, 623, 625 X; 200/61.83 X, 84 R, 84 C, 153 T, 85 R; 73/308, 313 X, 318; 307/118; 417/40, 211.5

[56] References Cited

U.S. PATENT DOCUMENTS 3,483,341 12/1969 Sperger ..... 200/84 R 3,944,770 3/1976 Pepper ..... 200/84 R 4,644,117 2/1987 Grimes ..... 200/84 R

FOREIGN PATENT DOCUMENTS 379099 7/1922 Fed. Rep. of Germany ... 200/61.83

*Primary Examiner*—G. P. Tolin

[57] ABSTRACT

A hollow floatable structure secured to a flexible electric cord for switching electric motor pumps or the like. The structure encloses an electric switch assembled with lever arm. The lever arm is positioned so that a sliding weight will actuate the switch. A part of the structure includes a properly positioned post which the gravity actuated weight slides upon.

6 Claims, 1 Drawing Sheet

MECHANICAL ACTUATED FLOAT SWITCH

BACKGROUND OF THE INVENTION

Omni Directional Float Switches manufactured to-date incorporate mercury as the current carrying element. The on-off differential is accomplished by running the mercury through an hour glass enclosure or capsule. The capsule environment must consist of inert gases for consistant reliable cycling, especially when used in applications requiring greater current draw. Because of the uncertainty of this environment and the cost invloved to produce, another method was sought. Mechanical float assemblies being produced have very complex switching arrangements and are normally not omni-directional. A crack or cut in the outer jacket of the cord allows water to wick into the assembly causing premature failures.

SUMMARY OF THE DESIGN

The outside of the float is composed of two plastic parts, the upper and lower moldings. The upper molding incorporates a post internally used as a weight slide. The bottom molding incorporates a lead seal pocket as well as mounting pads to hold and position the mechanical switch. When assembled, the properly designed weight provides the means for activating the switch. In application, as the liquid level goes higher the gravitational pull reaches a limit which overcomes the static friction forcing the weight to slide down the post activating the switch. The reverse principle applies as the float is lowered. The operational differential may be altered by changing the tether length—(the length of cord between the lower molding and the place it's secured.)

DESCRIPTION OF THE DESIGN

Figure 1:
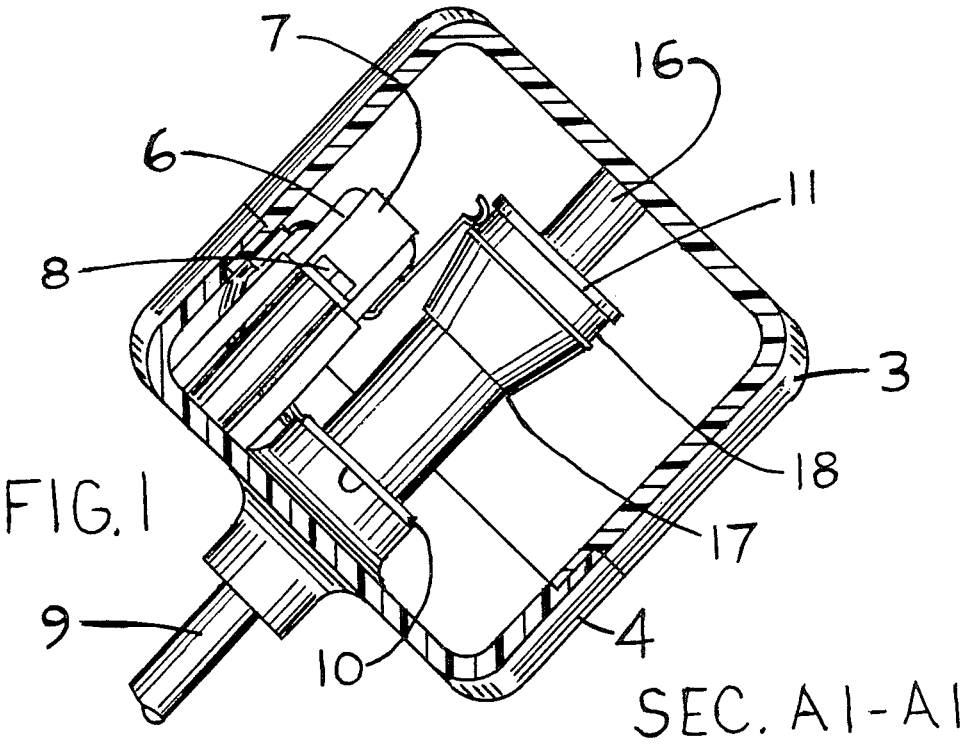
FIG. 1 shows the float assembly when the weight has slid down the post forcing the switch arm back.
Figure 2:
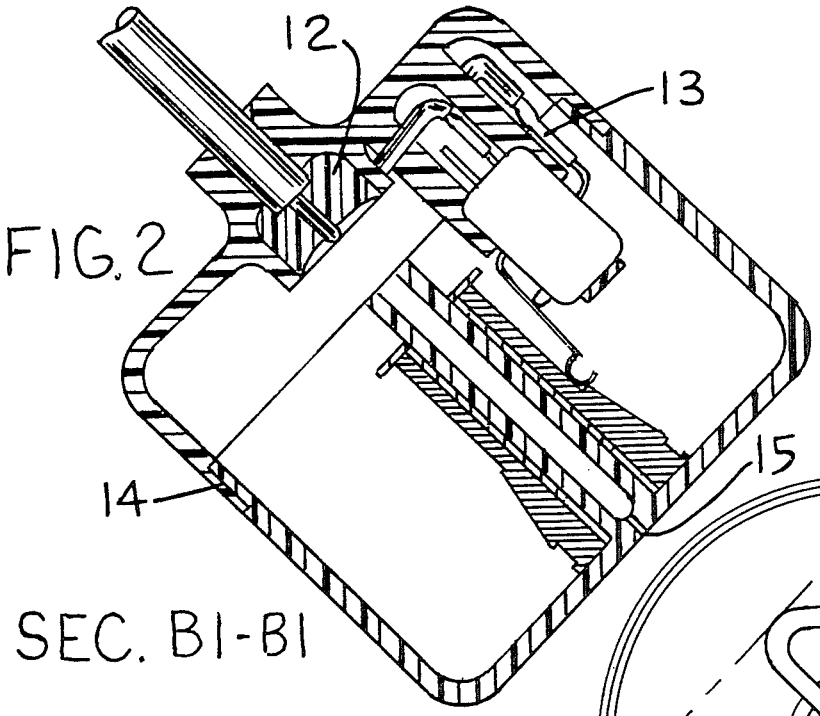
FIG. 2 shows the float assembly in the reverse location.
Figure 3:
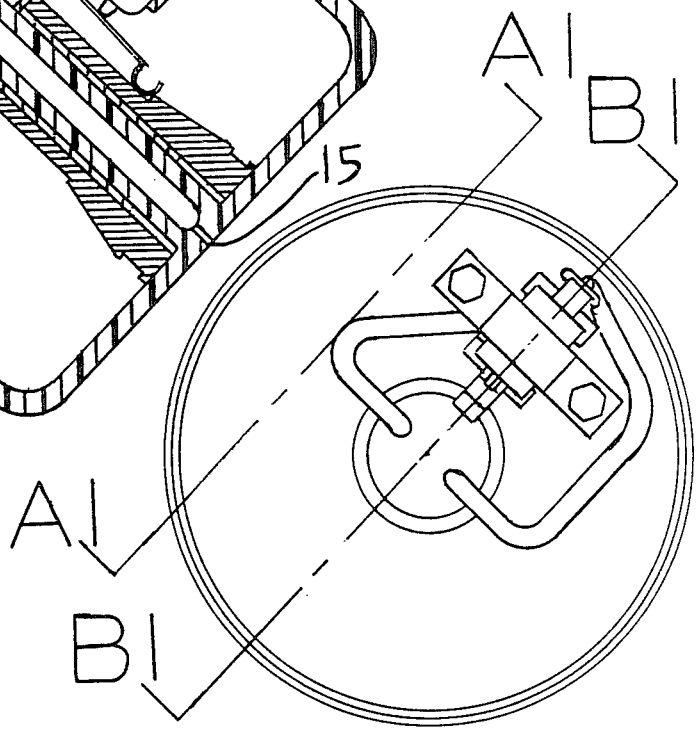
FIG. 3 shows an opened top view of the float assembly. Top view being opposite the lead entrance.

The float switch assembly, as shown on sheet 8, FIGS. 1–3, uses gravity to move the weight (item 11) up and down the post (item 16). A plastic insert (item 10) is pressed into the weight to reduce the CO efficient of friction between the post and weight. As the weight moves down, it comes in contact with the actuating member of the mechanical switch (item 6) closing the contacts. The weight has a step at the beginning of the incline (item 17) delaying movement until sufficient force is available to overcome the static friction involved. This allows for additional operating differential and eliminates the possibility of points arcing within the mechanical switch; in that the weight slides rapidly down the post closing the contacts immediately. In this position the actuating member is located within the upper groove (item 18) of the weight. This groove delays movement of the weight in the opposite direction using the same logic as discussed above. Operating differential can be reduced by eliminating this groove.

The float assembly consists of several parts. The lower molding (item 4) incorporates a lead seal pocket as well as mounting pads to hold and position the mechanical switch. The power leads (item 9) enter the enclosure through this lower molding. This lead is assembled so that the outer jacket of the cord is located approximately half way through the lead seal pocket. An appropriate potting compound (item 12) is then placed in the lead seal pocket. This seals the outer jacket of the cord to the lower molding and provides lead strain relief. The potting compound is placed over the outer jacket of the cord and the individual conductors also. This seals the enclosure, even if the jacket of the cord outside the compartment cranks or is cut during its operation.

The upper molding (item 5) incorporates a post which the weight slides up and down on. This molding is designed to mate with the lower molding and the two parts are sealed with a plastic adhesive (item 14).

The mechanical switch (item 6) has three $0.187 \times 0.020$ male terminals. This switch may be used for normally on or normally off operating positions when manufactured with a two-conductor cord. By using a three-conductor cord the switch can be connected for normally on and normally off operating positions. This mechanical switch is secured in position with a molded bracket (item 7) held in place with two screws (item 8). The power cord has female connectors (item 13) used to make connection with the appropriate terminals on the mechanical switch.

The hole (item 15) in the upper molding eliminates pressure build-up within the enclosure during assembly. It also provides an inspection port to insure the complete assembly is sealed. This is normally accomplished with pressure testing equipment. This hole is sealed with adhesive as a final assembly operation.

I claim:

1. A floating switch assembly including an electrical switch for activating electric submersible pumps and the like, said switch assembly floats on a liquid surface to sense changes in the levels of the surface by pivoting about a pivot provided by a flexible electric cord, comprising:

(a) an upper housing with a properly positioned post;

(b) a lower housing with leads sealed in a pocket and connected to said switch, and mounting pads securing said switch to said lower housing;

(c) said electrical switch having a lever arm which closes and opens the switch; and (d) a hollow weight forcibly guided along its inner surface by the post and caused to move by gravity and by liquid level, said weight moving said lever arm to actuate said switch.

2. A floating switch assembly as defined in claim 1 wherein the weight has a step at the beginning of an incline and a groove on the end to temporarily delay the movement of the weight.

3. A floating switch assembly as defined in claim 1 wherein the lower housing lead seal pocket when filled with an appropriate potting compound covers the outer jacket of the electric cord as well as the individual conductors.

4. A floating switch assembly as defined in claim 1 wherein the upper housing incorporates a hole.

5. A floating switch assembly as defined in claim 1 wherein the weight has a plastic insert.

6. A floating switch assembly as defined in claim 1 wherein the flexible electric cord in a normally on and/or normally off design incorporates a three conductor cord.

* * * * *